US007347159B1

(12) United States Patent
Thompson

(10) Patent No.: US 7,347,159 B1
(45) Date of Patent: Mar. 25, 2008

(54) COVER SUPPORT

(76) Inventor: David M. Thompson, 802 Mantoloking Rd., Bricktown, NJ (US) 08723

( * ) Notice: Subject to any disclaimer, the term of this patent is extended or adjusted under 35 U.S.C. 154(b) by 0 days.

(21) Appl. No.: 11/703,474

(22) Filed: Feb. 7, 2007

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS 4,927,109 A * 5/1990 Wilson ..... 248/354.3
7,146,926 B1 * 12/2006 Yang ..... 114/361

* cited by examiner

*Primary Examiner*—Ed Swinehart
(74) *Attorney, Agent, or Firm*—Andrew W. Ludy

(57) ABSTRACT

A boat cover support has a disc member placed against the cover. A vertical strut is received in a socket extending downward from the disc member. The socket has two opposed, semicircular walls to receive a circular strut. The ends of the socket walls are integral with the recesses. The ends of the socket walls are spaced apart to form a transverse notch through the socket to receive a rectangular strut. The disc member has slots arrayed in groups of three around the periphery. Straps extending from the slots outward are attached to the boat structure to stabilize the cover support. The disc member has four recesses with walls extending downward to reinforce the disc member and the socket. Lines extending from the recesses outward are attached to the boat structure to stabilize the cover support. Each recess has an interior cavity to receive a terminal knot in the line so as not to abrade the boat cover. A step is placed against the boat sole, to prevent the strut from slipping transversely.

14 Claims, 7 Drawing Sheets

COVER SUPPORT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of tent and boat cover supports, and more particularly to a disc structure to aid in supporting a fabric boat cover or tent.

It is well known that tents and boat covers require a rigid support centrally located and pushing upward to balance the weight of the cover and the downward pull of tent guy lines or boat snap fasteners. The rigid support typically takes the form of a pole or strut, which places great stress on the fabric, which then must be reinforced so as not to tear. Either end of the strut can slip transversely, or sideways, resulting in the cover collapsing. The boat can then fill with rainwater and sink.

Accordingly, there is a need to provide a cover support that can distribute stress over a wide area of the cover, so as to prevent tearing of the cover fabric, and without the need for reinforcement of the fabric.

There is a further need to provide a cover support of the type described and that can be secured so as to prevent the strut from slipping transversely.

There is a yet further need to provide a cover support of the type described and that will allow quick installation and removal of the strut.

There is a still further need to provide a cover support of the type described and that can be manufactured cost-effectively in large quantities of high quality.

BRIEF SUMMARY OF THE INVENTION

In accordance with the present invention, there is provided a cover support for use in connection with a boat. The boat has a sole (a floor), and a boat cover. A vertical strut extends from a lower end adjacent the sole to an upper end adjacent the cover. The cover support comprises a disc member having a convex upper surface for placement against the cover. The disc member has a lower surface, and a periphery. The disc member has a socket extending downward from the lower surface. The socket is adapted to receive the strut upper end.

The disc member has a plurality of slots spaced apart around the periphery in four groups of three. Up to four straps can be extended from the slots outward for attachment to the boat structure to stabilize the cover support.

The disc member has four recesses for receiving up to four lines. The lines can be extended from the recesses outward to stabilize the cover support. Each recess has a circular wall extending downward. The circular wall serves to reinforce the disc member. Each recess wall is also juxtaposed adjacent the socket to reinforce the socket. Each recess has a floor and a drain hole. Each recess has an interior cavity to receive a terminal knot in the line so as not to abrade the boat cover.

A step is placed against the sole, to prevent the strut from slipping transversely. The step has a pocket to receive the strut. The step has grip members extending downward.

BRIEF DESCRIPTION OF THE SEVERAL VIEWS OF THE DRAWING

A more complete understanding of the present invention may be obtained from consideration of the following description in conjunction with the drawing, in which.

DETAILED DESCRIPTION OF THE INVENTION

Figure 1:
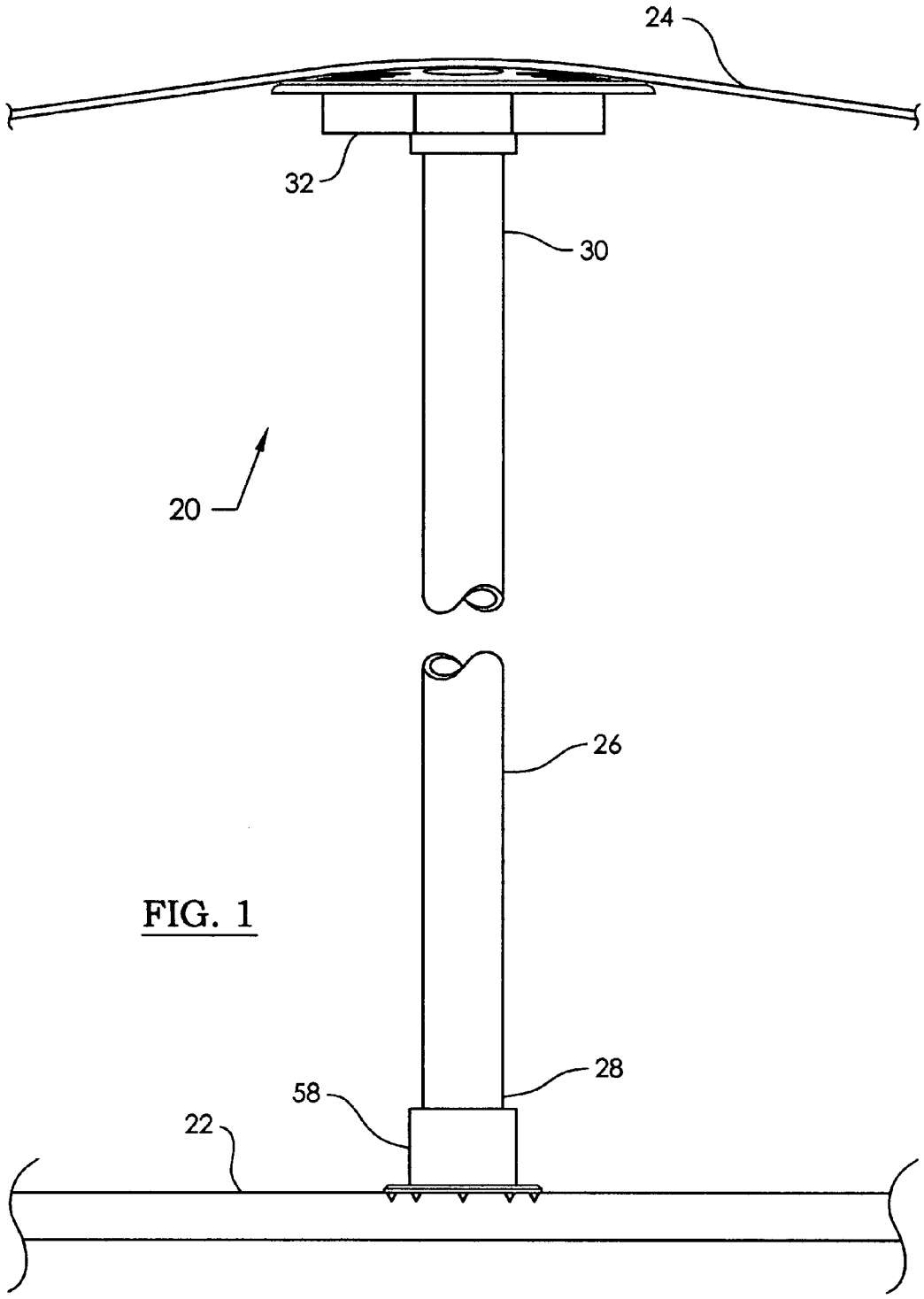
FIG. 1 is a front elevational view of a cover support assembly constructed in accordance with the invention, and installed in a boat.
Figure 3:
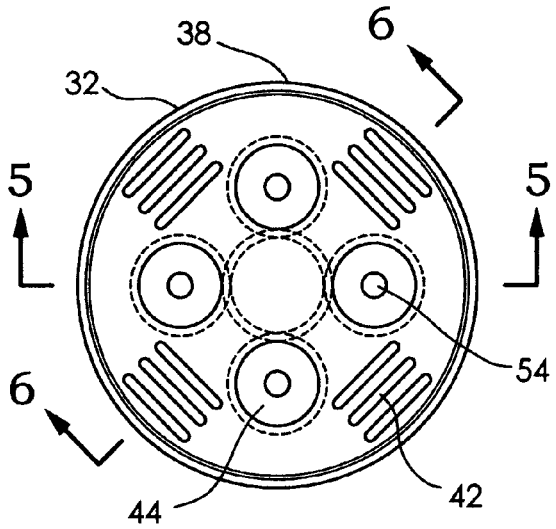
FIG. 3 is a top plan view of the disc member of FIG. 2.
Figure 8:
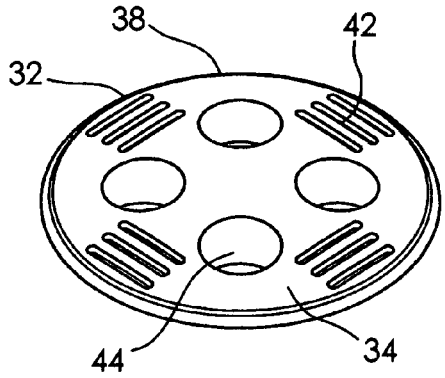
FIG. 8 is a top perspective view of the disc member of FIG. 2.
Figure 2:
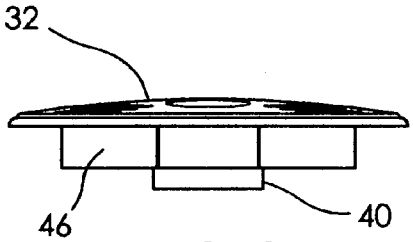
FIG. 2 is a front elevational view of a disc member of the cover support of FIG. 1.
Figure 7:
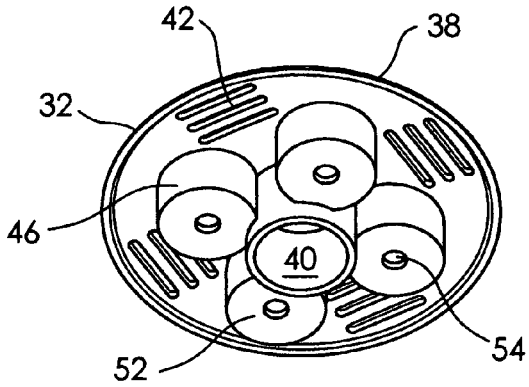
FIG. 7 is a bottom perspective view of the disc member of FIG. 2.
Figure 4:
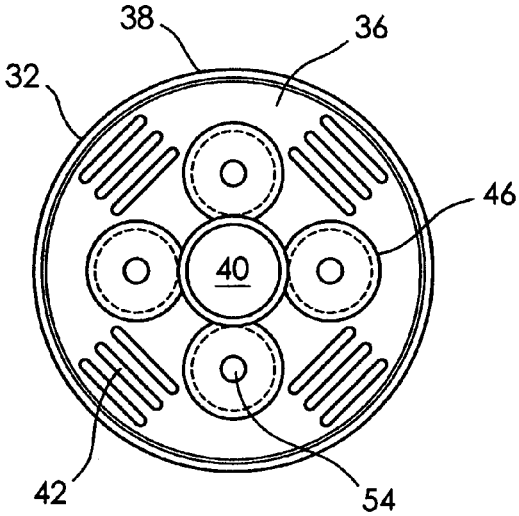
FIG. 4 is a bottom plan view of the disc member of FIG. 2.
Figure 6:
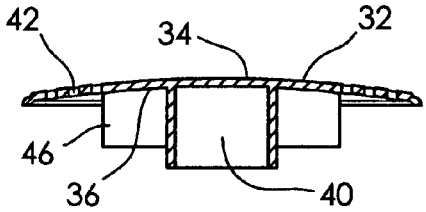
FIG. 6 is a side elevational cross-sectional view of the disc member of FIG. 2, taken along lines 6-6 of FIG. 3.
Figure 5:
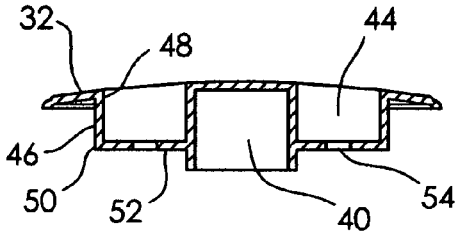
FIG. 5 is a front elevational cross-sectional view of the disc member of FIG. 2, taken along lines 5-5 of FIG. 3.

Referring now to the drawing, and especially to FIGS. 1-15 thereof, a cover support is shown at 20, and is for use in connection with a boat (not shown). The boat has a sole (a floor) 22, and a boat cover 24. A generally vertical strut 26 extends from a lower end 28 adjacent the sole 22 to an upper end 30 adjacent the cover 24. The cover support 20 comprises a disc member 32 having a convex upper surface 34 for placement against the cover 24. The disc member 32 has a lower surface 36, and a periphery 38. The disc member 32 has a socket 40 extending downward from the lower surface 36. The socket 40 is adapted to receive the strut upper end 30.

The disc member 32 has a plurality of slots 42 spaced apart around the periphery 38. Preferably, the slots 42 are arrayed in four groups of at least two, and preferably three. The slots 42 extend through the disc member 32 from the upper surface 34 to the lower surface 36. The groups are spaced angularly apart around the disc member 32, and are positioned adjacent the periphery of the disc member 32.

Figure 9:
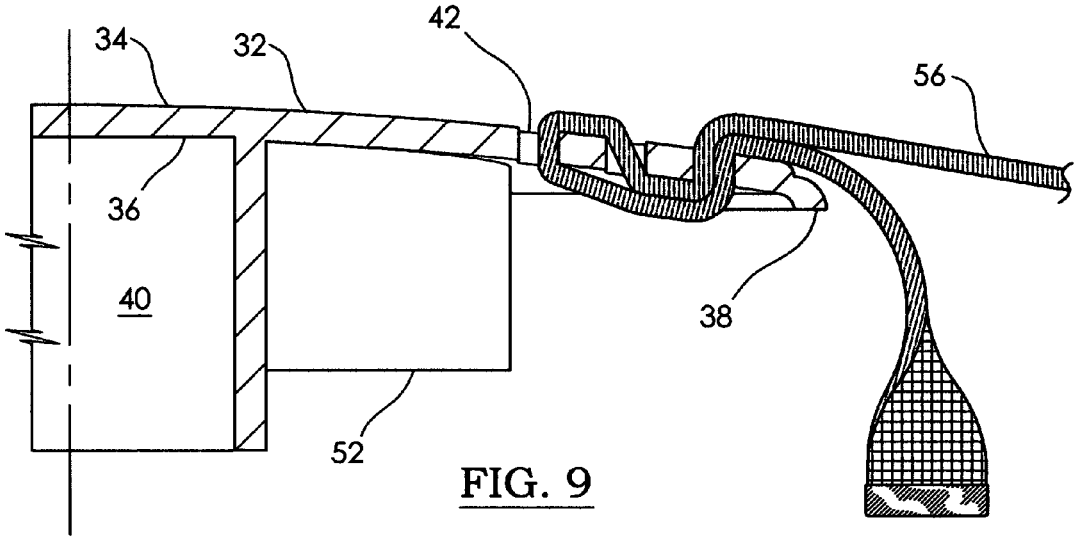
FIG. 9 is a partial side elevational cross-sectional view of the disc member of FIG. 2, taken along lines 6-6 of FIG. 3, and showing an adjustable strap.
Figure 13:
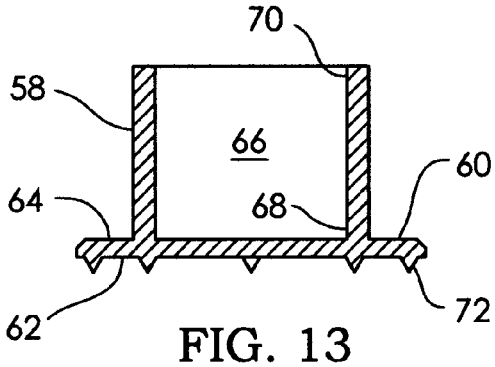
FIG. 13 is a front elevational cross-sectional view of the step of FIG. 11, taken along lines 13-13 of FIG. 12.
Figure 14:
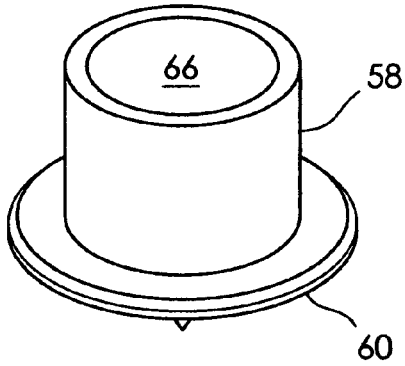
FIG. 14 is a top perspective view of the step of FIG. 11
Figure 12:
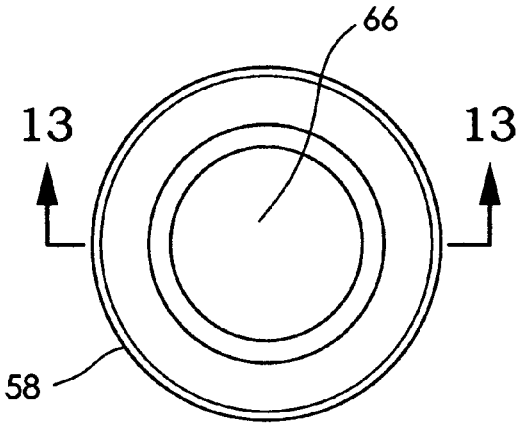
FIG. 12 is a top view of the step of FIG. 11.
Figure 15:
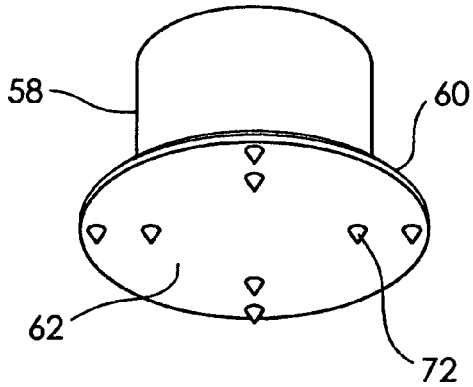
FIG. 15 is a bottom perspective view of the step of FIG. 10.
Figure 11:
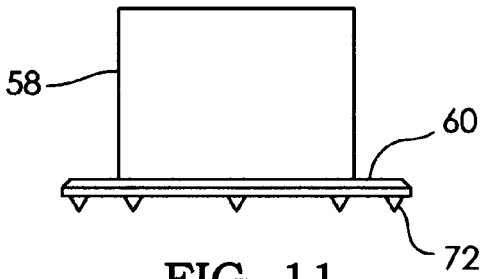
FIG. 11 is a front elevational view of a step of the cover support of FIG. 1.
Figure 18:
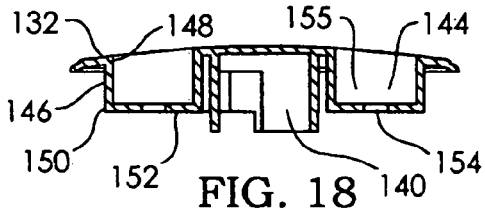
FIG. 18 is a front elevational cross-sectional view of the disc member of FIG. 16, taken along lines 18-18 of FIG. 17.
Figure 17:
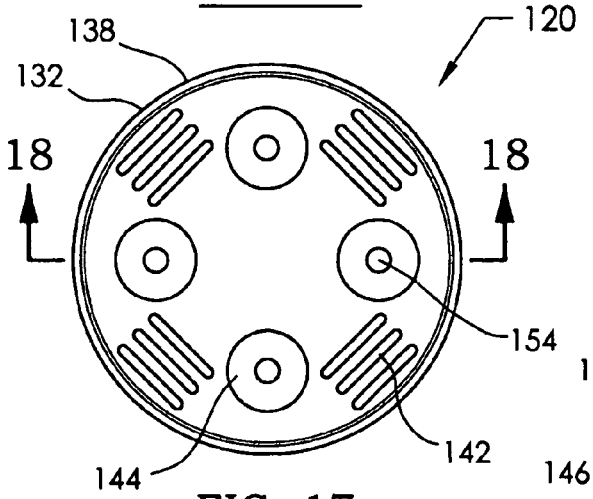
FIG. 17 is a top plan view of the disc member of FIG. 16.
Figure 16:
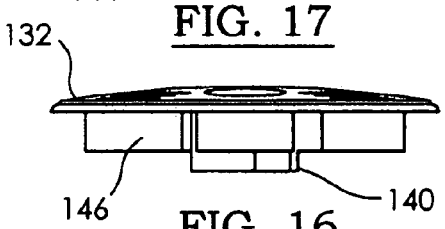
FIG. 16 is a front elevational view of another cover support disc member constructed in accordance with the invention.
Figure 19:
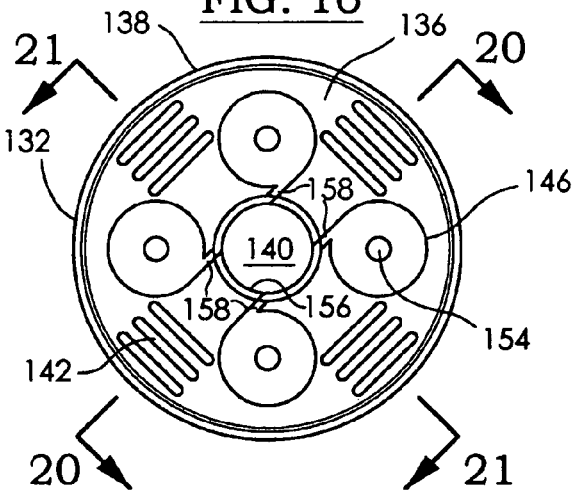
FIG. 19 is a bottom plan view of the disc member of FIG. 16.
Figure 23:
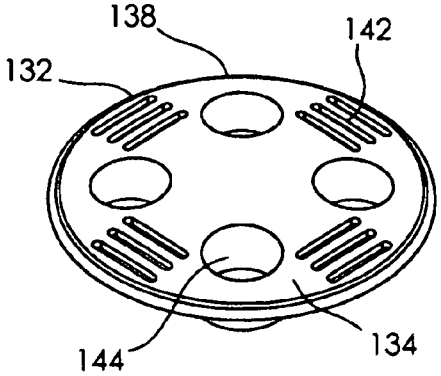
FIG. 23 is a top perspective view of the disc member of FIG. 16.
Figure 22:
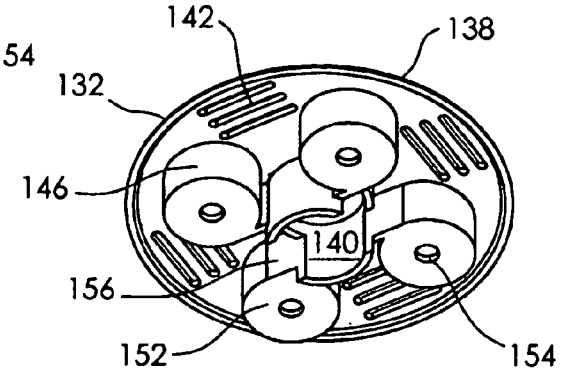
FIG. 22 is a bottom perspective view of the disc member of FIG. 16.
Figure 20:
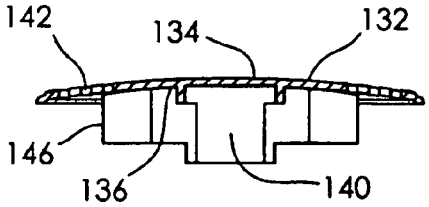
FIG. 20 is a side elevational cross-sectional view of the disc member of FIG. 16, taken along lines 20-20 of FIG. 19.
Figure 21:
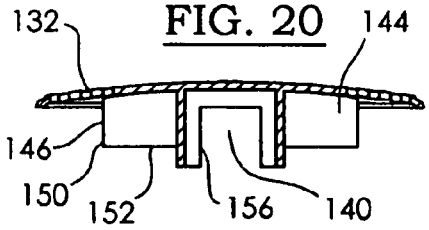
FIG. 21 is a side elevational cross-sectional view of the disc member of FIG. 16, taken along lines 21-21 of FIG. 19.

A plurality of straps 56 is provided to prevent the cover support 20 from slipping sideways. The straps are typically flat woven webbing, or strap material. Each slot 42 is adapted to receive one end of one of the straps 56, which is passed through the slot 42 as shown in FIG. 9. The length of each strap 56 is selectively adjustable by sliding through the slots 42. The straps 56 extend from the cover support 20 outward to port and to starboard and forward and aft. The opposite end of each strap 56 is attached to the boat structure so as to stabilize the cover support 20. Alternatively, the straps can be omitted, and the cover support 20 can be sewn right onto the boat cover 24 by zigzag stitching (not shown) through the slots 42. Another method of attachment is to install a snap fastener (not shown) at the center of the disc member 32, and a mating fastener to the boat cover 24. Yet another method of attachment is to install Velcro® material (not shown) to the disc member 32. The hook and loop fastener material can be sewn through the slots 42, and a mating material to the boat cover 24.

The disc member 32 has a plurality of novel reinforcing and stabilizing members, specifically four recesses 44. The recesses 44 are spaced angularly apart around the disc member 32. Each recess 44 has a recess wall 46 extending downward from a proximal end 48 at the disc member lower surface 36 to a distal end 50 so as to reinforce the disc member 32. The recess wall 46 is coextensive with the socket 40. Each recess wall 46 is juxtaposed adjacent the socket 40 so as to reinforce the socket 40. Each recess 44 has a floor 52 at the wall distal end 50. The floor 52 has a hole 54 through it. Each recess 44 has an interior cavity 55, which is open at the recess proximal end 48 through the disc member upper surface 34 and open through the hole 54.

Figure 10:
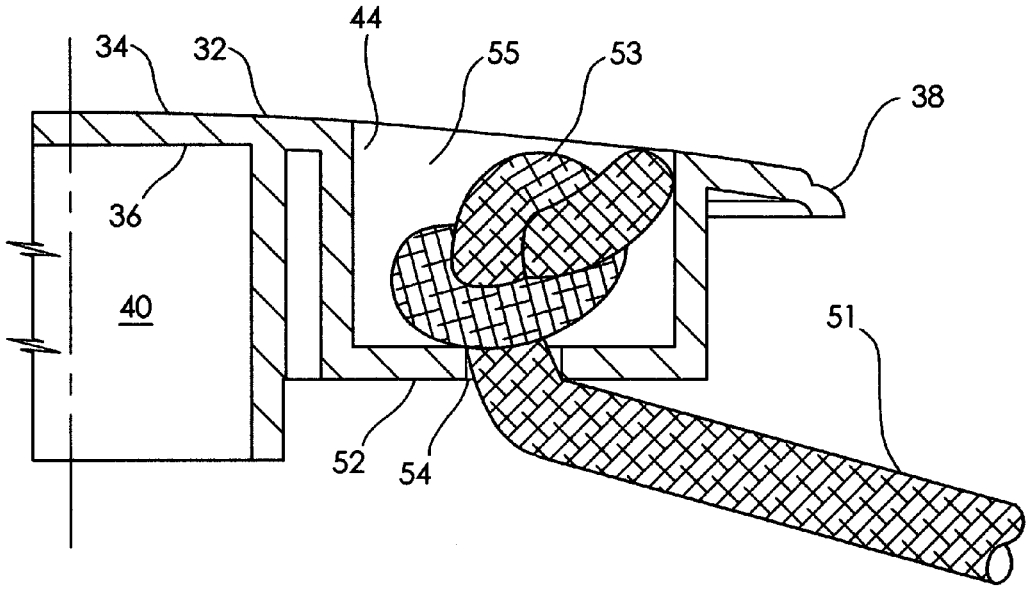
FIG. 10 is a partial side elevational cross-sectional view of the disc member of FIG. 2, taken along lines 5-5 of FIG. 3, and showing an adjustable line.

As an alternative stabilizing method, the boat includes a plurality of ropes, or lines 51 having a generally round cross-sectional shape. Each recess 44 is adapted to receive one end of one of the lines 51 upward through the hole 54, as shown in FIG. 10. In another novel feature, the interior cavity 55 of each recess 44 is adapted to receive a terminal knot 53 in the line 51 so as not to abrade the boat cover. The length of each line 51 is selectively adjustable in the recess by moving and retying the knot 53. An opposite end of each line 51 is adapted for attachment to the boat so as to stabilize the cover support 20.

An optional step 58 can be provided for placement against the sole 22, to prevent the strut 26 from slipping transversely, which would collapse the cover 24. The step 58 has a flange 60, with a lower surface 62 and an upper surface 64. The step 58 has a pocket 66 extending upward from a proximal end 68 adjacent the flange upper surface 64 to a distal end 70. The pocket 66 receives the strut lower end 28. The flange lower surface 62 has a plurality of grip members 72 extending downward. The grip members 72 are conical and pointed to penetrate and grip the sole 22, which is often carpeted. For use with the step 58, the strut 26 is generally circular in cross-section. In this case, the socket 40 is generally circular in cross-section for receiving the strut upper end 30.

Turning now to FIGS. 16-25, as well as FIGS. 1-15, another cover support constructed in accordance with the invention is shown at 120. Cover support 120 is similar to cover support 20 in that it comprises a disc member 132 having a convex upper surface 134 for placement against the cover 24. The disc member 132 has a lower surface 136, and a periphery 138. The disc member 132 has a socket 140 extending downward from the lower surface 136. The socket 140 is adapted to receive the upper end 130 of a strut 126.

The disc member 132 has a plurality of slots 142 spaced apart around the periphery 138. Preferably, the slots 142 are arrayed in four groups of at least two, and preferably three. The slots 142 extend through the disc member 132 from the upper surface 134 to the lower surface 136. The groups are spaced angularly apart around the disc member 132, and are positioned adjacent the periphery of the disc member 132.

The disc member 132 has four recesses 144. The recesses 144 are spaced angularly apart around the disc member 132. Each recess 144 has a recess wall 146 extending downward from a proximal end 148 at the disc member lower surface 136 to a distal end 150 so as to reinforce the disc member 132. The recess wall 146 is coextensive with the socket 140. Each recess wall 146 is juxtaposed adjacent the socket 140 so as to reinforce the socket 140. Each recess 144 has a floor 152 at the wall distal end 150. The floor 152 has a hole 154 through it. Each recess 144 has an interior cavity 155, which is open at the recess proximal end 148 through the disc member upper surface 134 and open through the hole 154.

Figure 24:
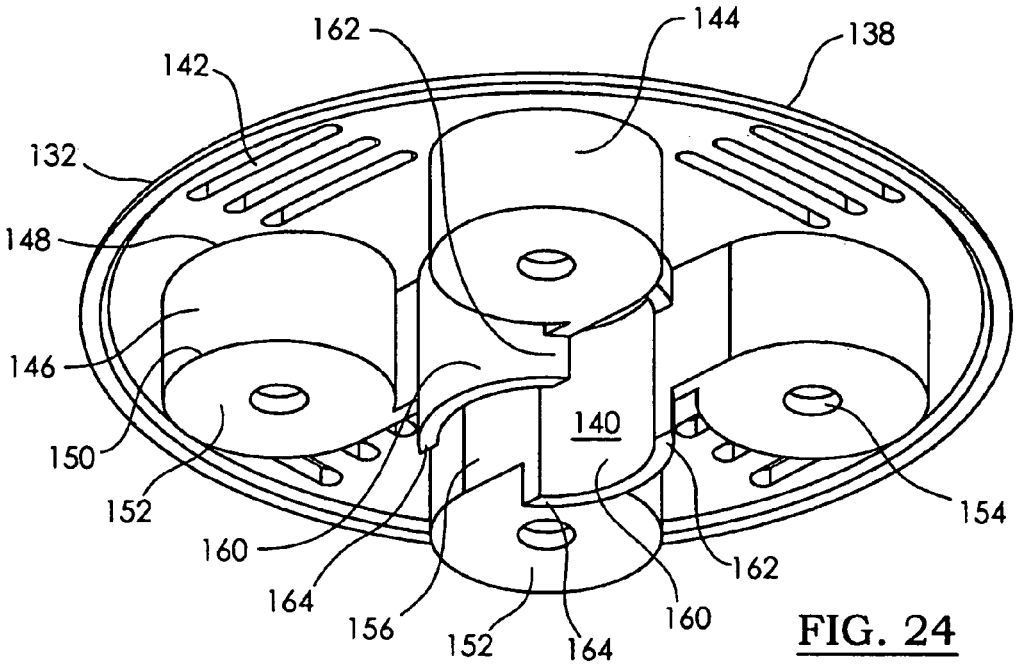
FIG. 24 is a bottom perspective view of the disc member of FIG. 16.
Figure 25:
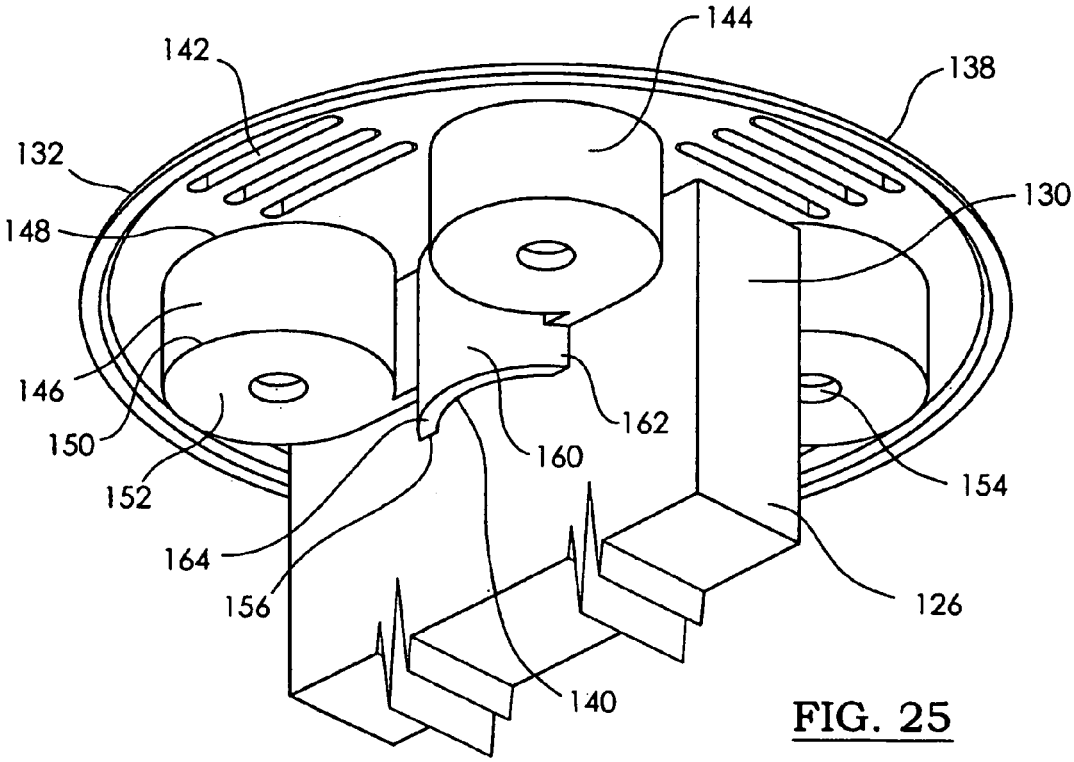
FIG. 25 is a bottom perspective assembly view of the disc member of FIG. 16, showing a rectangular strut engaging the disc member.
Figure 28:
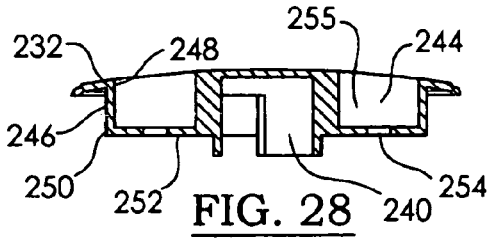
FIG. 28 is a front elevational cross-sectional view of the disc member of FIG. 26, taken along lines 28-28 of FIG. 27.
Figure 32:
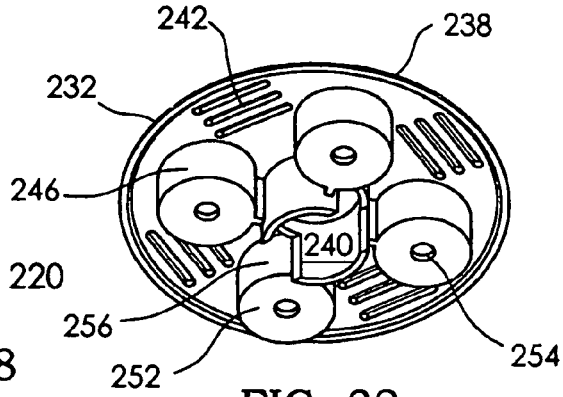
FIG. 32 is a bottom perspective view of the disc member of FIG. 26.
Figure 27:
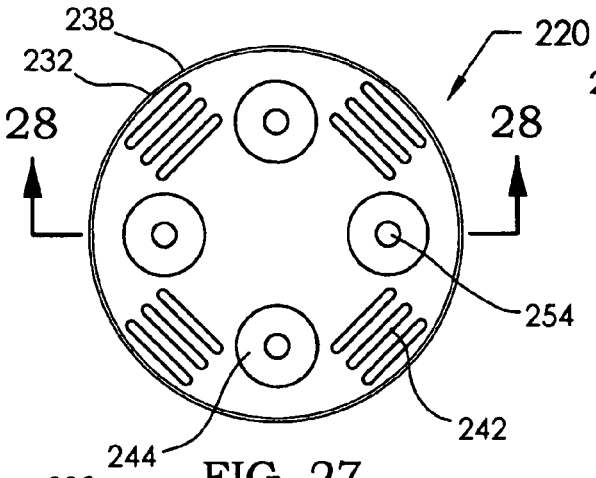
FIG. 27 is a top plan view of the disc member of FIG. 26.
Figure 33:
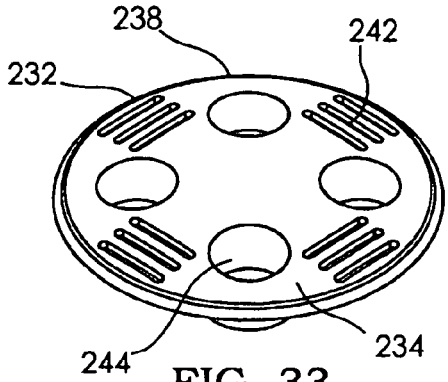
FIG. 33 is a top perspective view of the disc member of FIG. 26.
Figure 26:
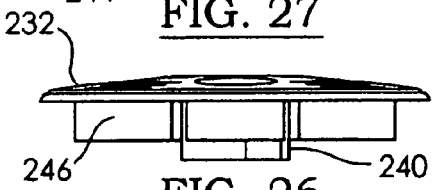
FIG. 26 is a front elevational view of yet another cover support disc member constructed in accordance with the invention.
Figure 30:
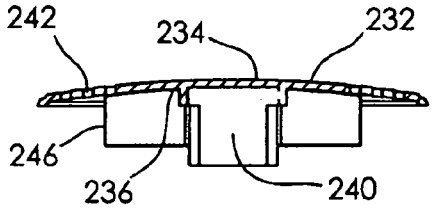
FIG. 30 is a side elevational cross-sectional view of the disc member of FIG. 26, taken along lines 30-30 of FIG. 29.
Figure 29:
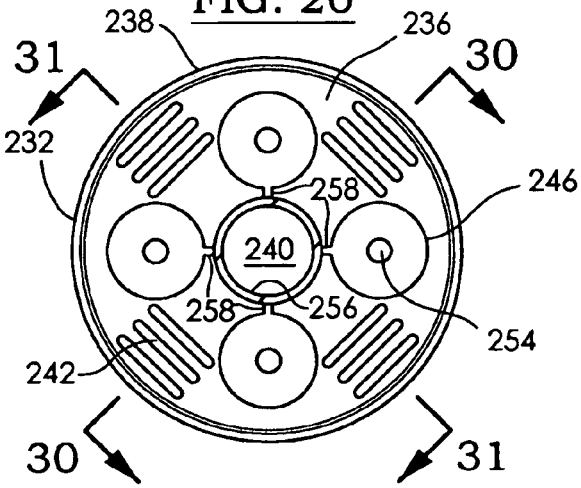
FIG. 29 is a bottom plan view of the disc member of FIG. 26.
Figure 31:
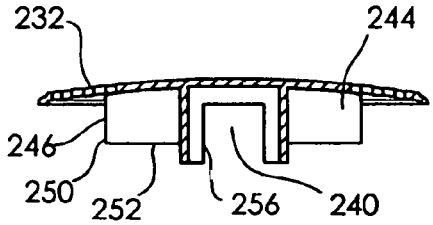
FIG. 31 is a side elevational cross-sectional view of the disc member of FIG. 26, taken along lines 31-31 of FIG. 29.

Cover support 120 differs from cover support 20 in that the socket 140 is configured for receiving either the circular strut 26, or an optional rectangular cross-section strut 126, as shown in FIG. 25. The socket 140 has two opposed, semicircular socket walls 160, which are adapted to receive the circular strut 26. Each semicircular socket wall 160 extends in a semicircle from a first end 162 to a second end 164. The first end 162 is integral with one of the plurality of recesses 144. The second end 164 is integral with another one of the recesses 144, as shown in FIG. 24. This so that the semicircular socket walls 160 and the recesses 144 will reinforce one another. The first ends 162 of the semicircular socket walls 160 are spaced apart from one another. The second ends 164 of the semicircular socket walls 160 are also spaced apart from one another. This forms a transverse notch 156 through the socket 140. The transverse notch 156 is adapted to receive the rectangular strut 126. The notch 156 is shown in FIGS. 19, 21, 22, and 24. Rectangular strut 126 can be quickly fabricated from scrap lumber or plywood found in any boatyard. An optional gusset 158 extends generally tangentially between the socket 140 and the recess circular wall 146 to reinforce the socket 140 at the notch 156. Preferably, however, the socket 140 and the recess circular wall 146 will be directly attached, as shown in FIGS. 3-7.

Referring now to FIGS. 26-33, as well as FIGS. 1-25, yet another embodiment of the cover support constructed in accordance with the invention is shown at 220. Cover support 220 is similar to cover support 120 in that it comprises a disc member 232 having a convex upper surface 234 for placement against the cover 24. The disc member 232 has a lower surface 236, and a periphery 238. The disc member 232 has a socket 240 extending downward from the lower surface 236. The socket 240 is adapted to receive the upper end 130 of a strut 126.

The disc member 232 has a plurality of slots 242 spaced apart around the periphery 238. Preferably, the slots 242 are arrayed in four groups of at least two, and preferably three. The slots 242 extend through the disc member 232 from the upper surface 234 to the lower surface 236. The groups are spaced angularly apart around the disc member 232, and are positioned adjacent the periphery of the disc member 232.

The disc member 232 has four recesses 244. The recesses 244 are spaced angularly apart around the disc member 232. Each recess 244 has a recess wall 246 extending downward from a proximal end 248 at the disc member lower surface 236 to a distal end 250 so as to reinforce the disc member 232. The recess wall 246 is coextensive with the socket 240. Each recess wall 246 is juxtaposed adjacent the socket 240 so as to reinforce the socket 240. Each recess 244 has a floor 252 at the wall distal end 250. The floor 252 has a hole 254 through it. Each recess 244 has an interior cavity 255, which is open at the recess proximal end 248 through the disc member upper surface 234 and open through the hole 254.

Cover support 220 differs from cover support 20 in that the socket 240 is configured for receiving either the circular strut 26, or the rectangular cross-section strut 126. The socket 240 has two opposed, semicircular socket walls 260, which are adapted to receive the circular strut 26. Each semicircular socket wall 260 extends in a semicircle from a first end 262 to a second end 264. The first end 262 is integral with one of the plurality of recesses 244. The second end 264 is integral with another one of the recesses 244. The first ends 262 of the semicircular socket walls 260 are spaced apart from one another. The second ends 264 of the semicircular socket walls 260 are also spaced apart from one another. This forms a transverse notch 256 through the socket 240. The transverse notch 256 is adapted to receive the rectangular strut 126. An optional gusset 258 extends generally radially between the socket 240 and the recess circular wall 246 to reinforce the socket 240 at the notch 256.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

PARTS LIST COVER SUPPORT

PART NO. DESCRIPTION

20 cover support
22 sole
24 boat cover
26 circular strut
28 strut lower end
30 strut upper end
32 disc member
34 disc member upper surface
36 disc member lower surface
38 disc member periphery
40 socket
42 slots
44 recess
46 recess wall
48 recess wall proximal end
50 recess wall distal end
51 lines
52 floor
53 terminal knot
54 floor hole
55 interior cavity
56 straps
58 step
60 step flange
62 flange lower surface
64 flange upper surface
66 pocket
68 pocket proximal end
70 pocket distal end
72 grip members
120 cover support
122 sole
126 rectangular strut
130 strut upper end
132 disc member
134 disc member upper surface
136 disc member lower surface
138 disc member periphery
140 socket
142 slots
144 recess
146 recess wall
148 recess wall proximal end
150 recess wall distal end
152 floor
154 floor hole
155 interior cavity
156 notch
158 gusset
160 semicircular socket wall
162 socket wall first end
164 socket wall second end
220 cover support
222 sole
226 rectangular strut
230 strut upper end
232 disc member
234 disc member upper surface
236 disc member lower surface
238 disc member periphery
240 socket
242 slots
244 recess

246 recess wall
248 recess wall proximal end
250 recess wall distal end
252 floor
254 floor hole
255 interior cavity
256 notch
258 gusset The embodiments of the invention in which an exclusive property or privilege is claimed are defined as follows:

1. A cover support for use in connection with a boat having a sole, a boat cover, and a generally vertical strut extending from a lower end adjacent the sole to an upper end adjacent the cover, the cover support comprising a disc member having an upper surface, a lower surface, and a periphery, the upper surface being adapted to bear against the cover, the disc member having a socket extending downward from the lower surface, the socket being adapted to receive the strut upper end, the disc member having a plurality of recesses, each recess having a wall extending downward from a proximal end at the disc member lower surface to a distal end so as to reinforce the disc member, the recess wall being coextensive with the socket, each recess wall being juxtaposed adjacent the socket so as to reinforce the socket, each recess having a floor at the wall distal end, the floor having a hole therethrough, each recess having an interior cavity, the interior cavity being open through the disc member upper surface and open through the hole.

2. The cover support of claim 1, wherein:

the boat includes a plurality of lines, the lines having a generally round cross-sectional shape; and the disc member further comprises the recesses being spaced angularly apart around the disc member, each recess being adapted to receive one end of one of the lines upward through the hole, the interior cavity of each recess being adapted to receive a terminal knot in the line so as not to abrade the boat cover, the length of each line being selectively adjustable in the recess by moving the knot, an opposite end of each line being adapted for attachment to the boat so as to stabilize the cover support.

3. The cover support of claim 1, wherein:

a first strut is generally circular in cross-section;

a second strut is generally rectangular in cross-section; and the socket further comprises two opposed, semicircular socket walls, the semicircular socket walls being adapted to receive the first strut, each semicircular socket wall extending in a semicircle from a first end to a second end, the first end being integral with one of the plurality, of recesses, the second end being integral with another one of the plurality of recesses, so that the semicircular socket walls and the recesses are mutually reinforced, the first ends of the semicircular socket walls being spaced apart, the second ends of the semicircular socket walls being spaced apart, so as to form a transverse notch through the socket, the transverse notch being adapted to receive the second strut.

4. The cover support of claim 1, wherein the boat includes a plurality of straps, the straps having a generally flat web cross-sectional shape; and the disc member further comprises a plurality of slots extending through the disc member from the upper surface to the lower surface, the slots being arrayed in groups of at least two slots per group, the groups being spaced angularly apart around the disc member and adjacent the periphery of the disc member, each group of slots being adapted to receive one end of one of the straps, the length of each strap being selectively adjustable in the slots, an opposite end of each strap being adapted for attachment to the boat so as to stabilize the cover support.

5. A cover support for use in connection with a boat having a sole, a boat cover, and a generally vertical strut extending from a lower end adjacent the sole to an upper end adjacent the cover, the boat having a plurality of straps, the straps having a generally flat web cross-sectional shape, the cover support comprising a disc member having an upper surface, a lower surface, and a periphery, the upper surface being adapted to bear against the cover, the disc member having a socket extending downward from the lower surface, the socket being adapted to receive the strut upper end, the disc member having a plurality of slots extending through the disc member from the upper surface to the lower surface, the slots being arrayed in groups of at least two slots per group, the groups being spaced angularly apart around the disc member and adjacent the periphery of the disc member, each group of slots being adapted to receive one end of one of the straps, the length of each strap being selectively adjustable in the slots, an opposite end of each strap being adapted for attachment to the boat so as to stabilize the cover support.

6. The cover support of claim 5, wherein the disc member further comprises a plurality of recesses, each recess having a wall extending downward from a proximal end at the disc member lower surface to a distal end so as to reinforce the disc member, the recess wall being coextensive with the socket, each recess wall being juxtaposed adjacent the socket so as to reinforce the socket, each recess having a floor at the wall distal end, the floor having a hole therethrough, each recess having an interior cavity, the interior cavity being open through the disc member upper surface and open through the hole.

7. The cover support of claim 6, wherein:

the boat includes a plurality of lines, the lines having a generally round cross-sectional shape; and the disc member further comprises the recesses being spaced angularly apart around the disc member, each recess being adapted to receive one end of one of the lines upward through the hole, the interior cavity of each recess being adapted to receive a terminal knot in the line so as not to abrade the boat cover, the length of each line being selectively adjustable in the recess by moving the knot, an opposite end of each line being adapted for attachment to the boat so as to stabilize the cover support.

8. The cover support of claim 6, wherein:

a first strut is generally circular in cross-section;

a second strut is generally rectangular in cross-section; and the socket further comprises two opposed, semicircular socket walls, the semicircular socket walls being adapted to receive the first strut, each semicircular socket wall extending in a semicircle from a first end to a second end, the first end being integral with one of the plurality of recesses, the second end being integral with another one of the plurality of recesses, so that the semicircular socket walls and the recesses are mutually reinforced, the first ends of the semicircular socket walls being spaced apart, the second ends of the semicircular socket walls being spaced apart, so as to form a transverse notch through the socket, the transverse notch being adapted to receive the second strut.

9. A cover support for use in connection with a boat having a sole, a boat cover, and a generally vertical strut extending from a lower end adjacent the sole to an upper end adjacent the cover, the cover support comprising a disc member having a convex upper surface for placement against the cover, a lower surface, and a periphery, the disc member having a socket extending downward from the lower surface, the socket being adapted to receive the strut upper end, the disc member having a plurality of slots spaced apart around the periphery, the slots extending through the disc member from the upper surface to the lower surface, the disc member having a plurality of recesses, each recess having a circular wall extending downward from a proximal end at the disc member upper surface to a distal end so as to reinforce the disc member, each recess wall being juxtaposed adjacent the socket so as to reinforce the socket, each recess having a floor at the wall distal end, the floor having a hole therethrough, each recess having an interior cavity, the interior cavity being open through the disc member upper surface and open through the hole.

10. The cover support of claim 9, wherein:

the boat includes a plurality of straps, the straps having a generally flat web cross-sectional shape; and the disc member further comprises the slots being arrayed in groups of three slots per group, the groups being spaced angularly apart around the disc member and adjacent the periphery of the disc member, each group of slots being adapted to receive one end of one of the straps, the length of each strap being selectively adjustable in the slots, an opposite end of each strap being adapted for attachment to the boat so as to stabilize the cover support.

11. The cover support of claim 9, wherein:

the boat includes a plurality of lines, the lines having a generally round cross-sectional shape; and the disc member further comprises the recesses being spaced angularly apart around the disc member, each recess being adapted to receive one end of one of the lines upward through the hole, the interior cavity of each recess being adapted to receive a terminal knot in the line so as not to abrade the boat cover, the length of each line being selectively adjustable in the recess by moving the knot, an opposite end of each line being adapted for attachment to the boat so as to stabilize the cover support.

12. The cover support of claim 9, wherein:

the strut is generally circular in cross-section; and the socket is generally circular in cross-section for receiving the strut upper end.

13. The cover support of claim 12, further comprising a step for placement against the sole, the step having a flange, the flange having a lower surface and an upper surface, the step having a pocket extending upward from a proximal end adjacent the flange upper surface to a distal end, the pocket being adapted to receive the strut lower end, the flange lower surface having a plurality of grip members extending downward therefrom so as to grip the sole and thereby prevent transverse slipping of the step.

14. The cover support of claim 9, wherein:

the strut is generally rectangular in cross-section; and the socket further comprises a transverse notch for receiving the strut upper end.

* * * * *